United States Patent [19]

Smith

[11] Patent Number: 4,586,896

[45] Date of Patent: May 6, 1986

[54] FLATBAKING METHOD AND APPARATUS

[76] Inventor: Robert S. Smith, 1263 Emory St., San Jose, Calif. 95126

[21] Appl. No.: 692,771

[22] Filed: Jan. 18, 1985

[51] Int. Cl.[4] ..... F27D 3/00; F24J 3/00; B02C 11/08; F26B 9/04

[52] U.S. Cl. ..... 432/9; 34/143; 100/93 P; 432/5; 432/231

[58] Field of Search ..... 432/5, 6, 231, 9; 219/390; 34/143, 145; 100/92, 93 P

[56] References Cited

U.S. PATENT DOCUMENTS 954,041 4/1910 McDougall ..... 34/143
4,456,448 6/1984 Pippert ..... 34/145
4,470,803 9/1984 Foster et al. ..... 432/5
4,499,821 2/1985 Clouston ..... 100/93

FOREIGN PATENT DOCUMENTS 281512 12/1964 Netherlands ..... 100/93 P

*Primary Examiner*—John J. Camby
*Attorney, Agent, or Firm*—Robert Samuel Smith

[57] ABSTRACT

A method of flattening a stack of sheets of material by assembling the stack horizontally in an oven of clamshell like construction and applying pressure to the stack hydraulically from an external pressure source by means of pistons entering the oven from each end.

2 Claims, 4 Drawing Figures

FLATBAKING METHOD AND APPARATUS

BACKGROUND OF THE INVENTION

1. Field of the Invention

This invention relates to an apparatus for flattening sheets of material such as aluminum by pressing and baking.

2. Description of the Prior Art

There are a number of applications where it is desirous to have very flat sheets of material. For example, one means for magnetic recording is to rotate a disk of aluminum whose flat surfaces are coated with a magnetic film. Information is stored in the magnetic coating by various alignment of the magnetization. A recording transducer, positioned close to the rotating surface may either store information by radiating a magnetic field which realigns the magnetization, or it may retrieve information by detecting the alignment. The closer the transducer is to the moving surface, the denser can be the information stored on the disk. For this reason, the recording industry has endeavored to make disks flatter and flatter in keeping with the demand for greater and greater information storage density.

At the present time, requirements for flatness are in the range of 50–500 microinches over a five inch span.

According to the present state of the art, the steps taken to manufacture an aluminum disk substrate, include:

Stamping out a blank disk from a sheet of aluminum that is about 0.085" thick. (the outside diameter may range from 3½ inches to 14 and the inside diameter may range from 1 to 6 inches depending on the ultimate use of the disk).

"Flatbaking" the disks which involves assembling the disks in vertical stacks, compressing the stack by laying heavy weights on top or enclosing the stack between platens which are forced together by springs, then placing the entire stack and compressing means into an oven, whence it is heated up to 650 degrees, F. and held at temperature for about two hours. At this temperature, the disks are sufficiently plastic that they flatten out due to the compressing force and retain their flat shape after cooling to room temperature.

The disk at this point is called a "blank" and is the form which is supplied to the recording media manufacturer for final machining, polishing and coating.

These latter steps include:

machining about 0.005 inches off each side of the disk. This operaation is performed to remove imperfections such as inclusions and scale in the disk surface which are introduced by the rolling process at the mill. Machining introduces "cold work" in the metal which causes the disks to warp. Therefore the manufacturer performs a second flatbake operation, identical to that described above in order to remove the warp. Then he polishes the disk so that it is now ready for coating.

The technique of flatbaking a second time as discussed above has been practiced for thirty years. There are a number of problems associated with this step which the present invention avoids. To understand the advantages of the invention, one must understand the differences in the crystalline state of the metal before the first flatbake and the second flatbake.

At the first flatbake stage, the crystals are small and strained by the rolling operation which has shaped the ingot into a sheet. A flatbake temperature of 650° F. is required because at this temperature, grain growth can occur and reorientation can take place so that the disk is left in an annealed (soft) state.

However, at the second flatbake stage, the condition of the metal is that relatively minor imperfections have been introduced in the surface by machining-imperfections such as dislocations which are misalignments in the crystall lattice and can be readily removed at 450° F. The presently used method of weights and spring does not flatten the disks at 450° F. simply because too much force is required. In order to flatten the disks with this amount of pressure, it it necessary to go up to a temperature of 650° F.

This involves expense in several ways.

When weights are used, the weights take up oven space and require heat; dwell time in the oven is considerably lengthened. When springs are used, the springs lose their temper at 650° F. and eventually must be replaced. Dwell time in the oven—time to heat up to 650° F., hold at temperature for two hours, cool to room temperature is typically 16 hours.

Another problem that results during the flat baking step is that, at 650° F., the surface of the disk becomes covered with aluminum oxide. Although the oxide film is very thin, its presense interferes with the job of polishing to an even flat fine finish.

Still another problem with flatbaking at 650° F. is that the disks become stuck together and are often extremely difficult to separate after they have cooled to room temperature. Yet another problem exists with the present method of flatbaking wherein disks are stacked in vertical columns. The height of the stack is limited to about twelve inches because:

there is an uneven weight between the top and bottom disks, the stack becomes top heavy, it is difficult to maintain alignment of the stack.

In view of these difficulties, it is an objective of this invention to provide an apparatus for flatbaking at a much reduced temperature. so that the disks will not stick together, the surfaces will not oxidize, the dwell time will be considerably shortened thereby effecting an economy of energy and oven space. It is an additional objective of this invention to provide an arrangement whereby the problems associated with limitation of vertical stacking are avoided.

SUMMARY OF THE INVENTION

An embodiment of this invention comprises an oven which is two hemicylinders joined in clamshell like construction in that one half of the oven is hinged to the (bottom) second half. When closed, the cylidrdrical axis of the oven is horizontal and rails in the bottom half support the disks which lie like slices of bread in a bread tray. The cylindrical oven has openings at each end so as to admit pistons which are hydraulically or pneumatically actuated by an external thermally insulated source of pressure. The disks can thereby be forced flat, even at room temperature so that flatbaking can be performed at a temperature of only 450° F.

BRIEF DESCRIPTION OF THE DRAWINGS

FIG. one shows one conventional method of flat baking a stack of disks.

FIG. two shows a second conventional method of flat baking a stack of disks.

FIG. three shows the method of flatbaking disks as per the invention.

FIG. four shows a method of carrying the disks to load the oven in FIG. three.

DISCUSSION OF THE PREFERRED EMBODIMENT

Figure 2:
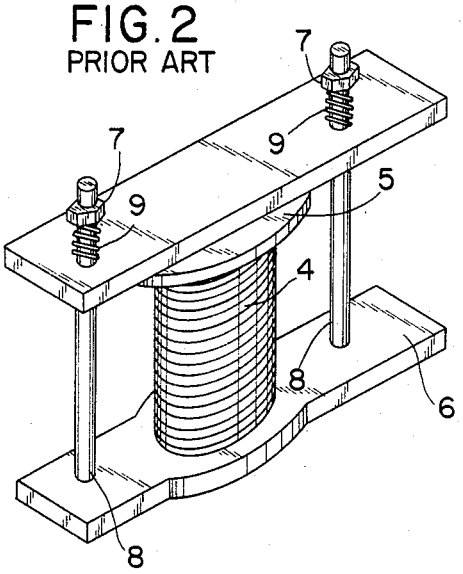
FIG. 2 PRIOR ART
Figure 1:
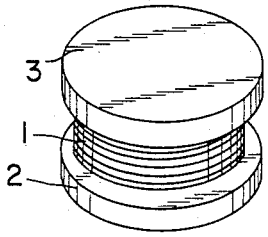
FIG. 1 PRIOR ART

Turning now to a discussion of the preferred embodiment, there are shown in FIGS. 1 and 2, the standard arrangement by which disks are flatbaked according to the prior art. In FIG. 1 there is shown a vertical stack of discs, 1, on top of platen, 2, On top of the disks is a weight of sufficient size, 3, that when the whole stack, 1,2, and 3, is taken to 650° F., the disks become more ductile and they flatten.

In FIG. 2, is shown another arrangement for flattening the disks according to the present state of the art. The stack of disks, 4, are seen to be held between two clamping platens, 5 and 6. Force is applied by tightening the nuts, 7, on the clamping bars, 8, which tightens springs, 9, In both the arrangements of FIGS. 1 and 2, common practice is to place the stacks (with other stacks) into the oven for the thermal cycle.

Figure 3:
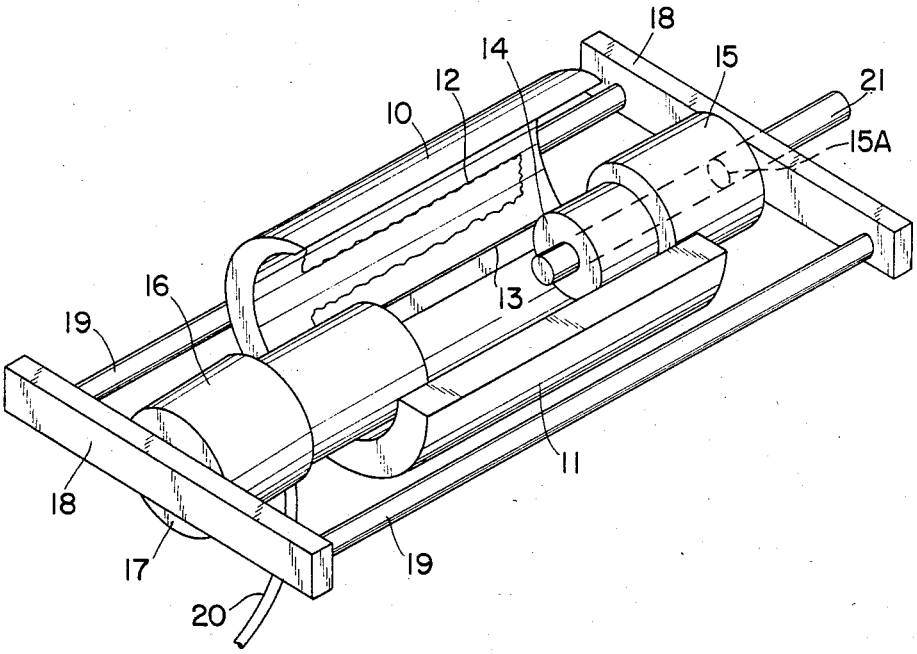

In FIG. 3 is shown the oven of the present invention. The top hemicylinder, 10, and bottom hemicylinder, 11, of the oven with heating elements, 12, are hinged along line, 13. A partial stack of disks, 14, are cradled in the oven and resting between fixed platen 15 and moveable platen 16.

A hydraulic ram, 17, supported by tie bars, 18, and the tie rods, 19, and driven through hydraulic pressure line, 20, forces the jaws, 5 and 6, together, thereby compressing the disk stack, 14.

Figure 4:
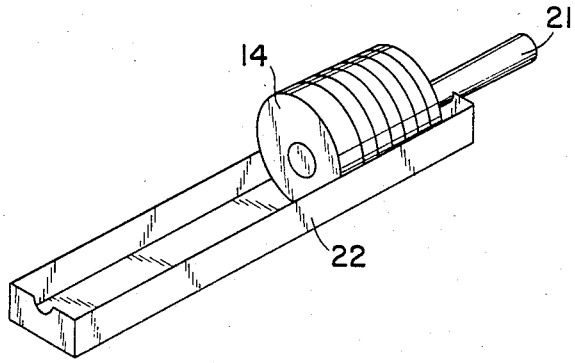

A hole 15*a* concentrically located in platen, 15, enables loading all of the disks onto transporting rod, 21, and then placing all of the disks into the oven simultaneously. The transporting rod, 21, may be removed by sliding it out through the hole 15*a*, in platen, 15. This feature provides a specia; advantage which may be understood by referring to FIG. 4. Here is shown a temporary transporting cradle, 22, for disks, 14 When the cradle is full, and the oven is ready, the transporting rod, 21, is slipped through the center hole in the stack of disks so that all of the disks can be lifted simultaneously out of the cradle and placed into the oven. In this manner the oven is always in full use.

When the oven is full, it is closed and the pressure is applied to compress the disks. A force of 5,000 pounds is easily applied and, on a disc diameter of 5 inches, this would correspond to 200 lbs./in$^2$. The force of 5,000 lbs. far exceeds the practical value that can be applied with weights or springs.

With 5,000 lbs. force exerted, the disks readily flatten out at room temperature. Therefore it has been found necessary to heat only to 450° F. and maintain at temperature for only 90 min. in order to flatten disks wherein warpage is due to cold work resulting from machining. This has made possible a four hour cycle time. Furthermore, there is relatively little oxidation of the disk surface and the disks do not stick together. The disks are flat to less than 50 microinches over 5 in.

I claim:

1. A method for flattening sheets of aluminum thinner than 0.085 inches that are warped by surface stresses resulting from coldwork introduced by machining which comprises:

assembling said aluminum sheets as a stack;

positioning said stack between a moveable platen and a fixed platen;

actuating a piston against said moveable platen so as to squeeze said stack between said platens thereby imposing a force against said moveable platen and aluminum surfaces that is greater than 200 pounds per square inch of aluminum surface which will flatten said aluminum sheets at room temperature;

enclosing said compressed stack within a heating enclosure means and, while maintaining said pressure in excess of 200 pounds per square inch, heating said stack to a range between 450 and 500 degrees fahrenheit for a period of time between 90 and 150 minutes;

maintaining said force until said stack is allowed to cool down to room temperature.

2. An apparatus for flatbaking a stack of sheets having edges wherein each said sheet has a hole and wherein said apparatus comprises:

a rod which passes through said holes in said sheets of said stack and so provides a means for supporting said sheets in order to transport said stack of sheets;

a bottom hemicylinder and a top hemicylinder hinged together along a straight horizontal edge of each hemicylinder thereby providing a clamshell structure and forming a cylindrical oven chamber with a centerline and having a first open end and a second open end and which may be opened and closed by rotation of said top hemicylinder about said hinging edge for the purpose of inserting said stack into said chamber;

heating means within said hemicylinders;

a fixed platen having a first flat surface parallel to a second flat surface wherein said first surface has a hole extending to said second surface and which fixed platen is positioned within said chamber perpendicular to the center line at said first end of said cylindrical chamber;

a movable platen which is positioned at said second end and perpendicular to the centerline of said cylindrical chamber;

a piston protruding through said second end and parallel to the centerline of said cylindrical oven chamber so as to contact said moveable platen;

means for force said piston against said moveable platen;

so that when said oven is open, said stack can be transported on said rod passing through said holes in said sheets to said oven and deposited between said platens so that said sheets are parallel to said platens and edges of said sheets rest on said bottom hemicylinder inside said oven chamber and so that said rod for transporting may then pass through said hole in said fixed platen thereby enabling said stack to be squeezed between said platens while said stack is heated.

* * * * *